US005921835A

United States Patent [19]

Gordon et al.

[11] Patent Number: 5,921,835

[45] Date of Patent: Jul. 13, 1999

[54] SAFETY DEVICE

[75] Inventors: Peter Cronin Gordon, 10 Hollytree Road, Liverpool L25 5PA, United Kingdom; Tor Christiansson, Skeppshult, Sweden

[73] Assignees: Peter Cronin Gordon, Liverpool, United Kingdom; C.M. Hammar AB, Vastra Frolunda, Sweden

[21] Appl. No.: 08/894,015

[22] PCT Filed: Feb. 15, 1996

[86] PCT No.: PCT/GB96/00324

§ 371 Date: Aug. 8, 1997

§ 102(e) Date: Aug. 8, 1997

[87] PCT Pub. No.: WO96/25326

PCT Pub. Date: Aug. 22, 1996

[30] Foreign Application Priority Data

Feb. 15, 1995 [GB] United Kingdom ..... 9502903

[51] Int. Cl.[6] ..... B63C 9/125

[52] U.S. Cl. ..... 441/95; 441/41

[58] Field of Search ..... 441/41, 92–95; 222/5

[56] References Cited

U.S. PATENT DOCUMENTS

| | | | |
|---|---|---|---|
| 2,839,767 | 6/1958 | Sieverts | 9/33 |
| 2,882,537 | 4/1959 | Lortz . | |
| 2,964,050 | 12/1960 | Novak | 441/97 |
| 3,314,088 | 4/1967 | Nordhaus et al. | 9/9 |
| 3,630,413 | 12/1971 | Beckes et al. | 222/5 |
| 3,716,882 | 2/1973 | Middleton, Jr. et al. | 441/94 |
| 3,802,012 | 4/1974 | Middleton, Jr. | 9/317 |
| 4,246,672 | 1/1981 | Fujiyama et al. | 9/321 |
| 4,498,605 | 2/1985 | Mackal et al. | 222/5 |
| 4,498,881 | 2/1985 | Buckle | 441/93 |
| 4,805,802 | 2/1989 | Mackendrick . | |
| 4,968,277 | 11/1990 | Parish et al. | 441/93 |

FOREIGN PATENT DOCUMENTS

| | | |
|---|---|---|
| 0236599 | 9/1987 | European Pat. Off. . |
| A474454 | 2/1915 | France . |
| A103790 | 3/1917 | United Kingdom . |
| 845014 | 8/1960 | United Kingdom . |
| 959128 | 5/1964 | United Kingdom . |
| 1466562 | 3/1977 | United Kingdom . |
| 2051212 | 1/1981 | United Kingdom . |
| 2083902 | 3/1982 | United Kingdom . |
| 2171962 | 9/1986 | United Kingdom . |

*Primary Examiner*—Sherman Basinger
*Attorney, Agent, or Firm*—Christie, Parker & Hale, LLP

[57] ABSTRACT

An inflation device for a buoyancy body such as a life jacket or life raft having a pressurized gas cylinder mounted within the buoyancy body and including an actuator, preferably in the form of a rotatable shaft, which projects from the interior to the exterior of the body so that it can be used to cause release of gas into the body and is operable from the exterior of the inflation device.

13 Claims, 7 Drawing Sheets

SAFETY DEVICE

BACKGROUND OF THE INVENTION

The present invention relates to inflation devices for inflation of buoyancy bodies such as lifejackets or liferafts.

A well known type of life-jacket comprises an impermeable outer skin defining an internal cavity. Typically, a proportion of this internal cavity is filled with a buoyant material to provide an initial, low, level of buoyancy and the skin is inflated by injection of gas to provide a higher level of buoyancy when needed. Alternatively, in some lifejackets the internal cavity is initially empty, and must be inflated to provide any buoyancy.

It is known to provide lifejackets with an externally mounted cylinder containing pressurised gas for inflation of the outer skin. The cylinder is connected via a one way valve (typically a Schraeder valve) to a passage in flow connection with the internal cavity.

The neck of the externally mounted cylinder is initially sealed by a metal closure diaphragm, and a mechanism is provided whereby the diaphragm is punctured when, for example, an actuating tag is pulled, causing inflation of the lifejacket.

Such lifejackets suffer from a number of disadvantages. The external cylinder is inconvenient to the wearer as it tends to catch on obstacles (which is a particular drawback on boats, which provide a large number of obstacles such as ropes, ladders etc). It is also vulnerable to physical damage by impacts, and is unprotected from the corrosive effects of water. Known cylinders typically have a cadmium outer plating which, in combination with the metal components of the valve and the actuating mechanism and in the presence of salt water, gives rise to electrolytic corrosion.

Another problem associated with these known lifejackets arises at low temperatures. The cylinders are filled with $CO_2$ gas which, as it expands, can freeze, thereby blocking the (usually restricted) passage through which the gas enters the internal cavity.

There have been attempts in the past to overcome these problems by mounting the gas cylinder within the internal cavity of the lifejacket. In one such lifejacket an inflation assembly comprising the cylinder and the mechanism for puncturing its metal closure diaphragm is placed loose within the internal cavity, being accessible only via a sealable hole in the outer skin.

To pierce the closure diaphragm, the user locates the inflation assembly by feel through the outer skin, and then squeezes a handle through the skin to cause inflation.

This operation requires time and a degree of manual dexterity, which can be problematic since in emergencies it is often very important to inflate a lifejacket quickly.

Further, exposure to cold, particularly cold water, can make any kind of manipulation very difficult the user's hands may become too numb to be used effectively, so that inflation of the lifejacket is hard to achieve.

A further type of lifejacket with an internally mounted inflation cylinder is described in GB 2171962. In this case, the outer skin is formed with a projecting elongate pocket. A movable lever of the inflation assembly projects into the said pocket, and a cord is tied to the distal end of the outside of the pocket surrounding both the pocket and the lever so that pulling on the cord moves the lever, puncturing the metal closure diaphragm and inflating the lifejacket.

This lifejacket is complicated to manufacture, since the outer skin must be formed to provide the projecting pocket.

It is also complicated to assemble; the inflation assembly must first be inserted through a gap in a seam of the outer skin. Then the movable lever must be located in the pocket, and the cord tied around the pocket, retaining the lever, and the gap in the seam must then be welded closed.

The lifejacket in question is not reusable. The inflation assembly is permanently sealed within the jacket, so that after one inflation (which exhausts the gas cylinder) the cylinder cannot be replaced.

Additional problems arise where the inflation device in question is adapted to be automatically triggered when its associated buoyancy body is placed in water. Such automatic inflation devices are used on lifejackets and liferafts, and several types are known.

Some known automatic inflation devices are electrically controlled, being responsive either to the reduction in resistance between two external electrical contacts when both are immersed in water, or to the electromotive force generated by a sea water actuated electric cell. In the latter type of device salt water acts as the electrolyte of the cell.

When used to cause inflation of buoyancy bodies, electrical release devices suffer from serious disadvantages. Devices which rely on a reduction in resistance must include a battery or cell, which is certain to discharge over time and so require periodic maintenance. Large numbers of life vests are stored in ships and aeroplanes, and must be kept in constant readiness, so that it is important to maximize the service interval of the release device.

Further, electrical release devices must cause inflation of a buoyancy body by electrical or electromechanical means, and known ways of achieving this are not ideal. One type of device uses a retainer which is electrically melted to release an inflation mechanism, but low water temperatures can prevent melting of the retainer and so cause the unit to fail with potentially life threatening consequences. Another type of device uses an electronically ignited explosive charge to release gas, but there are concerns regarding the safety of detonating such a charge on a personal flotation device.

Still another important disadvantage of electrically actuated release devices in the present context is that they can be accidentally released, e.g., by humidity or spray.

It is also known to provide a mechanical release device to cause automatic inflation of a buoyancy body. One such device is described in GB 2051212 and comprises first and second internal chambers (the first chamber being open to ingress of water, while the second chamber is sealed) separated from each other by a spring biased diaphragm which is movable by hydrostatic water pressure within the first chamber. Motion of the diaphragm directly actuates a spring loaded gas release device.

One of the problems associated with such known mechanical release devices actuated by hydrostatic pressure arises from the fact that the depth to which a buoyancy body is immersed is typically small. The small resultant hydrostatic pressure frequently does not produce a large enough force to overcome friction in the release device. The problem is compounded in mechanical devices of the above described type by the fact that the diaphragm must be moved against the force caused by air within the second (sealed) internal chamber. Since the air within the second chamber cannot escape, it effectively biases the diaphragm against motion in the release direction.

For these reasons, reliable inflation is often not achieved using known devices responsive to and actuated by hydrostatic pressure. Again, this can cause non-inflation of a life vest or liferaft which can endanger life.

Another type of automatic release device suited to use in conjunction with inflatable buoyancy bodies comprises a retainer which is softened or dissolved upon contact with water. For example, a salt plug may be used to retain a spring loaded gas release mechanism, so that when the salt plug is exposed to water and dissolved, the gas release mechanism is released.

The major problem with this known type of release mechanism is that the retainer tends to absorb moisture from the air, and over time this leads to unintentional softening of the retainer, with consequent release of gas and inflation of the buoyancy body. For this reason, the retainer in buoyancy bodies with this type of release must be periodically replaced.

SUMMARY OF THE INVENTION

It is an object of the present invention to overcome the above described problems associated with the prior art.

More specifically, a first object of the present invention is to provide an inflation device for a buoyancy body which does not make the buoyancy body inconvenient to wear/use.

It is a further object of the present invention to provide an inflation device which can be reliably, automatically actuated upon placement in water but which is protected from accidental actuation by moisture, spray and humidity.

It is still a further object of the present invention to provide an inflation device which can be reliably actuated at the small hydrostatic pressures associated with shallow immersion in water.

In accordance with a first aspect of the present invention, there is provided an inflation device for a buoyancy body having an outer skin defining an internal cavity and an aperture in the skin, the inflation device comprising cover means adapted to be mounted on the buoyancy body, forming a seal therewith which surrounds the aperture in the skin, means for mounting a gas container within the internal cavity and actuating means extending through the cover means for causing release of gas from the container, the inflation device being adapted to be automatically actuated upon immersion and additionally comprising means defining a chamber, means defining a first opening or passage for connecting the chamber to the interior of the buoyancy body, means defining a second opening or passage for connecting the chamber to the exterior, a one way valve which normally closes the second opening or passage, biasing means which constantly urge the actuating means toward a gas release position, and restraint means, comprising a water degradable element disposed within the chamber, which normally retain the actuating means in an inactive position, the one way valve being adapted to be opened by excess external pressure produced upon immersion, allowing admission of water to the chamber and consequent release of gas from the gas container into the buoyancy body.

Preferably, the cover means is adapted to be removably mounted on the buoyancy body.

Still more preferably, the cover means defines a recess adapted to receive a sealing ring of the buoyancy body and thereby to form the seal.

To form an improved seal, in a particularly preferred embodiment the sealing ring comprises a resilient undercut lip for resiliently sealing against the recess.

In accordance with a second aspect of the present invention, there is provided an inflatable buoyancy body comprising an outer skin defining an internal cavity, the buoyancy body being provided with an inflator comprising means for mounting a pressurized gas container within the cavity and actuating means extending from the interior to the exterior of the cavity for causing release of gas from the container, the inflator being adapted to automatically cause inflation of the buoyancy body upon immersion and further comprising a housing defining a chamber, means defining a first opening or passage connecting the chamber to the internal cavity of the buoyancy body, means defining a second opening or passage for connecting the chamber to the exterior, a one way valve which normally closes the second opening or passage, biasing means which constantly urge the actuating means toward a gas release position, and restraint means, comprising a water degradable element disposed within the chamber, which normally retain the actuating means in an inactive position, the valve being adapted to be opened by excess external pressure produced upon immersion allowing admission of water to the chamber and consequent release of gas from the pressurised gas container into the buoyancy body.

BRIEF DESCRIPTION OF THE DRAWINGS

Specific embodiments of the present invention will now be described, by way of example only, with reference to the accompanying drawings, in which.

DETAILED DESCRIPTION OF THE INVENTION

Figure 1:
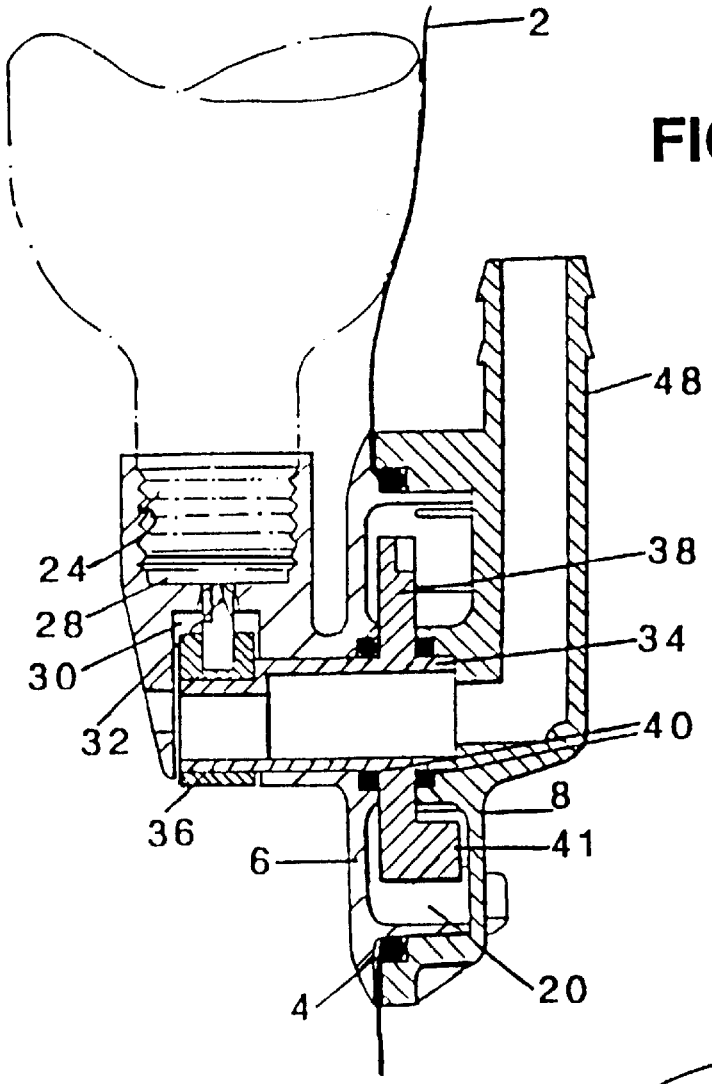
FIG. 1 is a cross-sectional view of a manually actuated inflation device.

The illustrated inflation devices are all adapted to be sealingly mounted at an aperture in a buoyancy body, and thereby to mount a pressurized gas cylinder within the buoyancy body. In each case, actuating means which can be operated (be it manually or automatically) from outside the buoyancy body are provided.

The device illustrated in FIGS. 1 to 4 will be described first. Very briefly, this embodiment uses a gas cylinder which is normally sealed by a closure diaphragm 28 at its neck. To inflate the buoyancy body, the user pulls a cord connected to a radially projecting lever 38, which rotates a hollow shaft 34. An eccentric portion 36 of the shaft 34 then drives a spur 32 through the diaphragm 28, releasing gas directly into the buoyancy body.

This device will now be described in more detail.

As shown in FIG. 1, a flexible outer skin 2 of a buoyancy body such as a lifejacket or liferaft is penetrated by a circular opening, the perimeter of which is welded to a resilient "0" ring 4. The "0" ring 4 is retained in an annular cavity formed between a closure body 6 and an outer sealing cover 8, and is squeezed by inner faces of the said annular cavity, forming a seal therewith, and thereby sealing the circular opening in the outer skin 2.

The closure body 6 (best shown in FIG. 3) comprises a disc portion 10 from a front face of which projects a concentric annular collar 12. Slots are formed in the annular collar 12, producing sprung tongues 14 projecting beyond the collar which bear, at their ends, outwardly directed undercut lugs 16.

Figure 2:
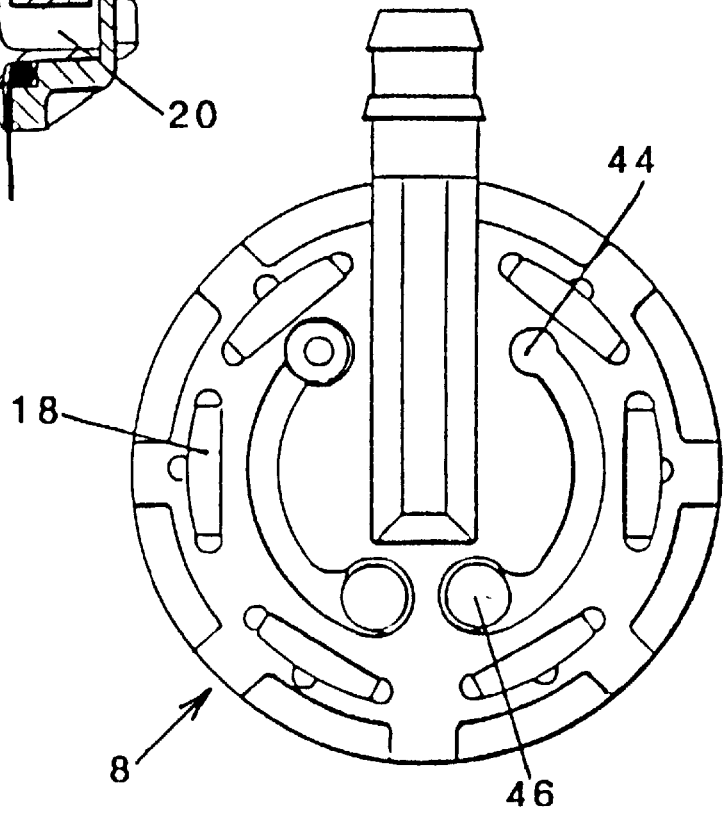
FIG. 2 is a front view of an outer sealing cover according to the device shown in FIG. 1.
Figure 3:
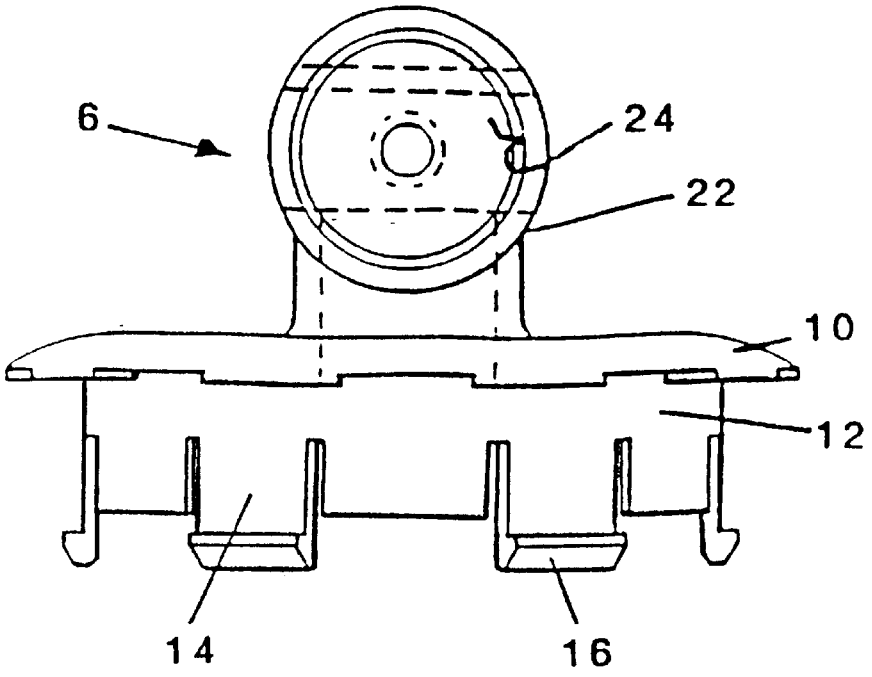
FIG. 3 is a side view of a closure body forming part of the device shown in FIG. 1.

A front view of the sealing cover 8 is shown in FIG. 2. It has a circular perimeter and is penetrated by a plurality of slots 18 equal in number to the number of sprung tongues 14.

When the closure body 6 and the outer sealing cover 8 are assembled together, as in FIG. 1, the annular collar 12 of the closure body is located in an annular recess 20 in the rear face of the sealing cover, and the sprung tongues 14 project through the slots 18 in the sealing cover so that the undercut lugs 16 engage with the front face of the sealing cover and thereby hold the body and cover together.

Projecting from the rear face of the closure body is a connecting elbow portion 22 with a vertical threaded bore 24 to receive the neck of a gas cylinder 26. The gas cylinder is initially sealed by the metal closure diaphragm 28.

Below the vertical threaded bore 24, and in communication therewith, is a vertical stepped bore 30, within which is mounted a slide member from which the spur 32 projects upwards. The tip of the spur lies adjacent the metal closure diaphragm 28.

The closure body 6 has a horizontal bore within which is journalled the hollow shaft 34 with the eccentric portion 36 which is received in a bore in the slide member.

Figure 4:
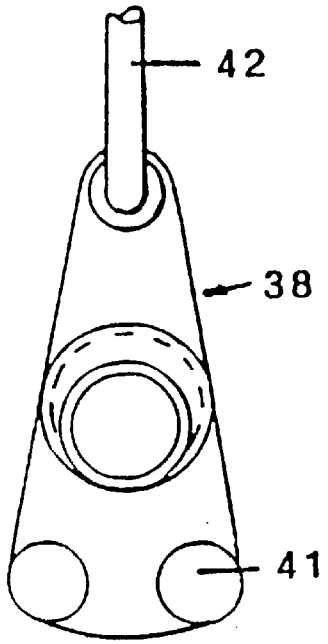
FIG. 4 shows a shaft and lever of the FIG. 1 device.

As FIGS. 1 and 4 show, the hollow shaft 34 is provided with a radially projecting lever 38, which is retained between opposing faces of the closure body 6 and the sealing cover 8. A substantially gas impermeable seal is provided by two "0" rings 40 contained in respective annular cavities between the closure body 6 and the lever 38 and between the sealing cover 8 and the lever 38, so that gas cannot escape around the hollow shaft 34.

At a lower edge of the lever 38 are two indicator discs 41, colored green, while at an upper edge the lever is connected to a cord 42 (see FIG. 4).

The cord 42 is led out through one of two arcuate slots 44 in the sealing cover 8 (see FIG. 2). At the lower end of both of the arcuate slots 44 are holes 46 through which the two green indicator discs 41 can normally be seen.

When it is desired to inflate the buoyancy body, the user pulls downwards on the cord 42, thereby rotating the hollow shaft 34. As the shaft rotates, the eccentric portion 36 forces the slide member upwards so that the upwardly projecting spur 32 punctures the closure diaphragm 28, and the gas within the cylinder is released directly into the buoyancy body.

A visual indication that the gas has been released is provided by the indicator discs 41, which are no longer visible through the holes 46.

Should the buoyancy body begin to deflate, it can be topped up via an oral inflation tube 48 provided on the front of the sealing cover 8. This tube is in flow communication with the hollow shaft 34, and thus with the interior of the buoyancy body. It is sealed using a one way valve (not shown) connected to its upper open end. The one way valve is further connected to a flexible tube or mouthpiece into which the user can blow.

It will be appreciated that the inflation device described above is securely located relative to the buoyancy body, in contrast to the two prior art inflation devices with internal cylinders described above, which are loose within the buoyancy body.

A further advantage is the ease of assembly achieved by this inflation device. The gas cylinder 26 and the mounting body 6 are first inserted through the hole in the outer skin 2, then the sealing cover 8 is pushed over the circular lip 12 and is instantly locked in place by the undercut lugs 16 in a quick and simple operation.

The inflation device can be quickly and easily removed for maintenance or for replacement of the cylinder simply by pushing back the undercut lugs 16, removing the sealing cover 8 and drawing the inflation device and gas cylinder out through the opening in the outer skin 2.

Problems of physical damage and corrosion are substantially reduced because most of the working parts of the present invention are Protected within the sealed environment of the buoyancy body.

A dessicant may be placed within the buoyancy body to provide further protection.

Since gas does not have to enter the buoyancy body through a passage, as in the prior art devices with external cylinders, there is a reduced risk of frozen gas preventing gas flow.

Figure 5:
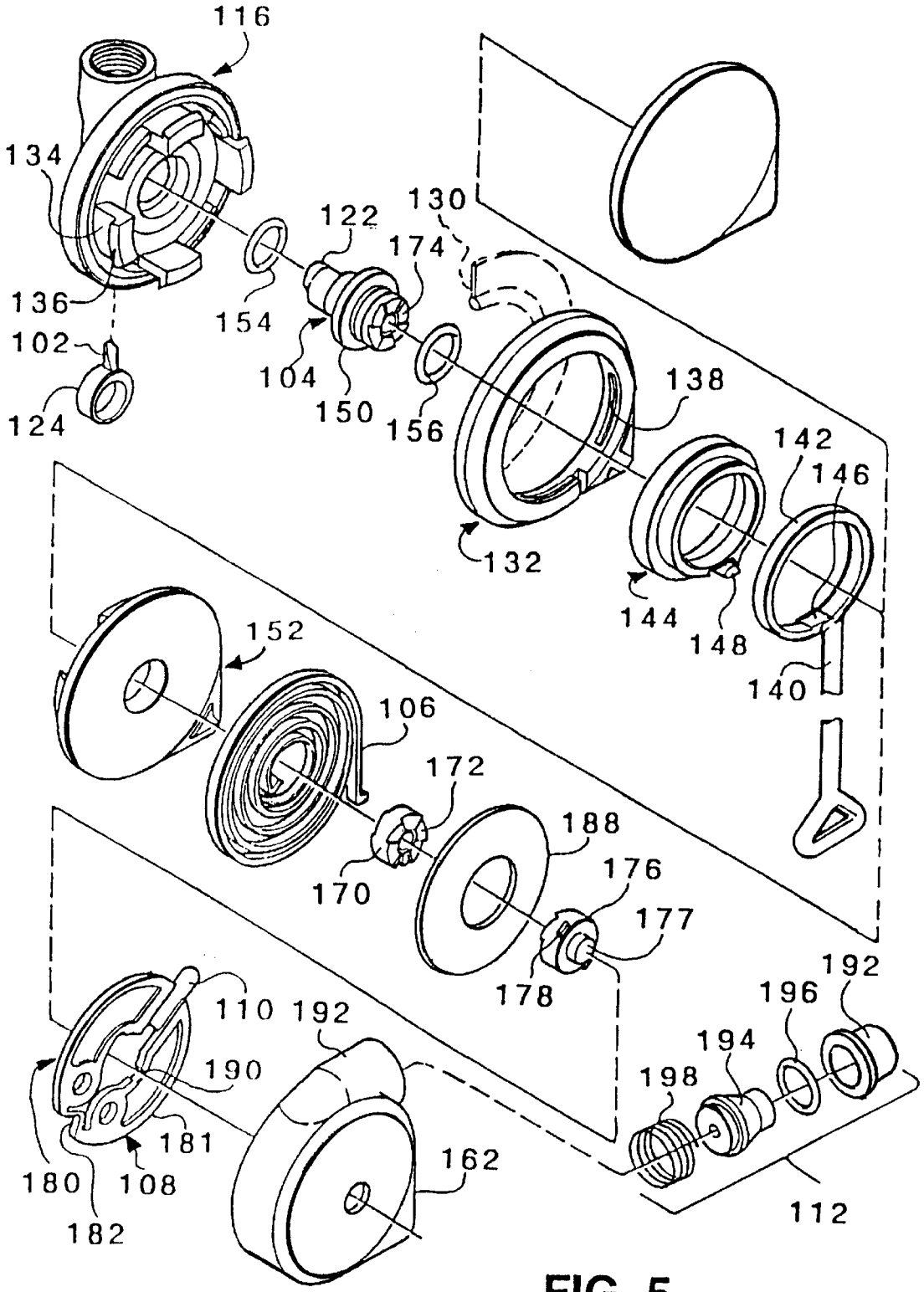
FIG. 5 is an exploded view of an automatic inflation device constructed in accordance with the present invention.

All of the above described advantages are also achieved by the automatically actuable inflation device according to the present invention illustrated in FIGS. 5, 6 and 7, which will now be described.

Briefly, this embodiment is like the previously described device in that it uses a normally sealed gas cylinder 100 which is pierceable by a spur 102 driven by an eccentric portion of a shaft 104. In this instance, however, the shaft is constantly urged to rotate by a spiral spring 106 and is normally prevented from rotating by restraint means 108 comprising a water degradable element 110. The water degradable element is contained in a chamber within the inflation device, this chamber being in flow communication with the interior of the buoyancy body but being normally sealed to the exterior by a valve 112.

When external pressure on the valve 112 is increased due to submersion, this valve opens, admitting water which destroys the water degradable element 110. The restraint means 108 is thus rendered inoperative so that the shaft 104 is rotated by the spiral spring 106, and gas is thereby released.

The present embodiment of the invention will now be described in more detail.

Figure 6:
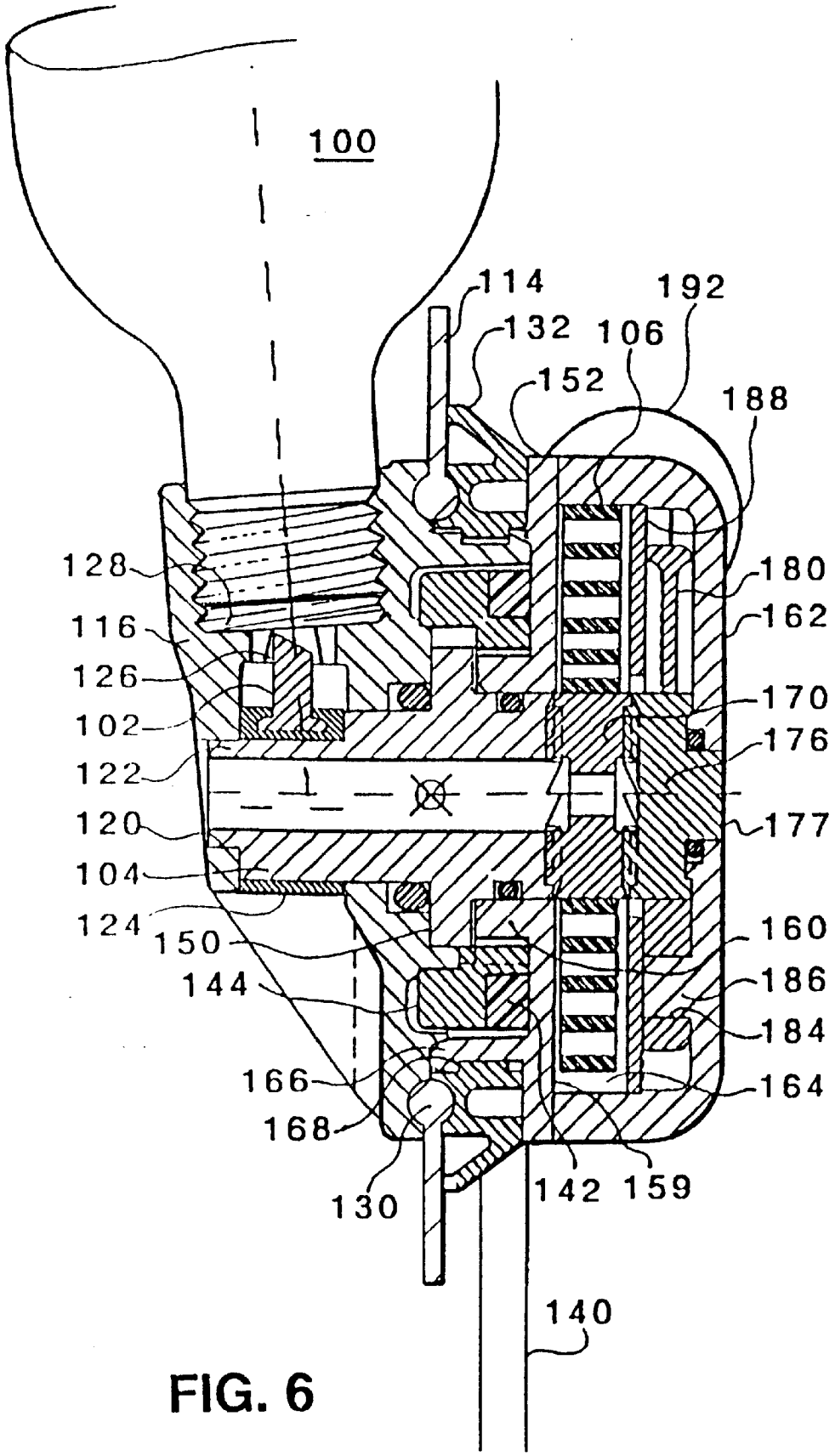
FIG. 6 is a cross-sectional view of the FIG. 5 embodiment.
Figure 7:
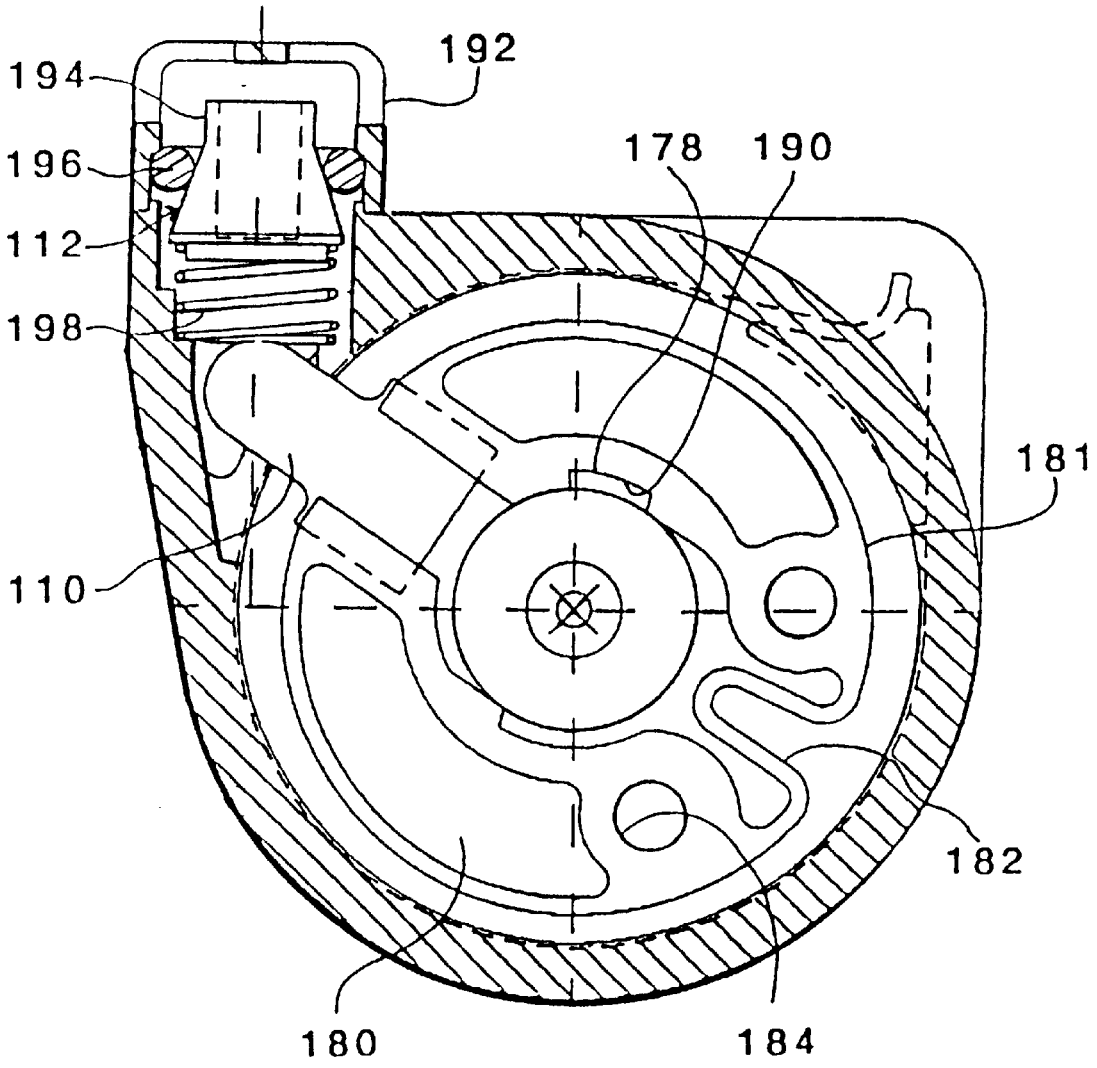
FIG. 7 is a sectional view of the FIG. 5 embodiment seen from the front.

As in the above described manually actuated inflation device, the gas cylinder 100 of the present embodiment is contained within a buoyancy body in use, (the skin of the buoyancy body is shown at 114 in FIG. 6). The neck of the gas cylinder 100 is threadedly received in an inclined bore in a body 116. The shaft 104, penetrated by a through-going axial bore, is journalled in and extends forward from a bore 120 in the body 116 (in what follows, the forward direction is the direction from inside the buoyancy body to outside the buoyancy body—i.e., from left to right as shown in FIG. 6, and "front" and "rear" are to be correspondingly construed).

A rearward portion 122 of the shaft 104 is eccentric, and journalled thereon is a ring 124 to which is joined the spur 102, the spur projecting through a tapered vertical bore 126 in the body 116 toward a metal closure diaphragm 128 of the gas cylinder. As in the previously described embodiment, rotation of the shaft causes the spur 102 to be forced through the diaphragm 128, releasing gas from the cylinder directly into the buoyancy body.

Mounting of the present inflation device on the buoyancy body is achieved by means of a resilient sealing ring 130 joined to or integrally formed with the skin 114 of the buoyancy body and sealingly received in an annular recess defined between a front face of the body 116 and a rear face of a locking ring 132. The body and locking ring are adapted to be attached to one another by means of sprung undercut lugs 134 integrally formed with and projecting forward from the body 116, which have outwardly directed teeth 136 for engagement with respective shoulders 138 provided at a radially inner face of the locking ring 132 (see FIG. 5). In this way, a part turn lock is produced.

Thus, to mount the device on a buoyancy body, one need only place the gas cylinder 100 and body 116 within the buoyancy body, locate the sealing ring 130 on the front face of the body, and push the locking ring 132 (bearing additional components, to be described below) onto the body, and rotate to lock.

Removal of the device is also very simple. It will be seen in FIG. 5 that the shoulders 138 do not extend around the entire circumference of the locking ring 132. Rotation of the locking ring relative to the body thus causes the teeth 136 to disengage from the shoulders 138, allowing separation of the locking ring from the body.

While the present embodiment is adapted to be automatically activated upon immersion, it is provided with a "back-up" mechanism for manual activation. The mode of operation of this mechanism is similar to the operation of the previously described manual inflation device, although the details of the mechanism are different and will now be described.

An actuator is provided in the form of a single piece moulding of flexible plastics comprising an elongate cord 140 and an actuator ring 142. As before, the cord 140 is led out of the device to be accessible to the user. The actuator ring 142 is received on a reduced diameter portion of a drive ring 144, and rotation of the actuator ring relative to the drive ring is prevented by means of a projection 146 from the radially inner face of the actuator ring 142, which engages with a tongue 148 at the radially outer face of the drive ring 144. The drive ring itself engages with the shaft 104.

Now, in the assembled device the cord 140 is passed in a clockwise direction (when the device is viewed from the front) around the actuator ring 142, so that when the user pulls sufficiently hard on the cord the actuator ring is rotated, and this rotation is transmitted via the drive ring 144 to the shaft 104, causing rotation of the shaft and consequent release of gas. During rotation of the shaft, a ratchet (to be described below) connecting the shaft to the automatic release mechanism slips.

The shaft 104 comprises, part way along its length, an integrally formed collar 150 which, by abutment against a front face of the body 116 and a rear face of a mounting ring 152 (to be described below) substantially prevents longitudinal motion of the shaft. Immediately to the rear of the collar 150 is a first sealing ring 154 disposed within an annular cavity defined between the shaft 104, its collar 150 and the body 116. A portion of the shaft 104 in front of the collar 150 is journalled in a bore of the mounting ring 152, and this portion of the shaft comprises an annular recess containing a second sealing ring 156. The first and second sealing rings 154, 156 serve to prevent ingress of water or egress of gas.

The mounting ring 152 comprises a circular disc portion 159 from the rear face of which projects a collar 160; the bore which receives the shaft 104 is within the collar 160. Joined to the front face of the mounting ring 152 is a substantially cup-shaped housing 162, and between the housing and the mounting ring is defined an internal chamber 164 containing components of the automatic activation mechanism. It should be noted that the chamber 164 communicates with the interior of the buoyancy body via the bore in the shaft 104, and is normally sealed from the exterior by the valve 112.

The assembly comprising the mounting ring 152 and the housing 162 is attached at a front face of the locking ring 132 by means of undercut lugs 166, projecting from the rear face of the circular disc portion 158, whose outwardly directed teeth engage with corresponding shoulders 168 formed at a radially inner face of the locking ring 132.

Within the chamber 164 is contained the coiled spring 106 which, acting via a ratchet wheel 170, constantly urges the shaft 104 to rotate in a clockwise direction. Both axially outer faces of the ratchet wheel 170 are provided with ratchet teeth 172. The ratchet teeth on the rear face of the ratchet wheel 170 engage with corresponding ratchet teeth 174 formed on the front end of the shaft 104, so that the ratchet wheel 170 can drive the shaft 104 in a clockwise direction but the shaft remains free (particularly during manual operation) to rotate clockwise relative to the ratchet wheel.

Rotation of the ratchet wheel 170 in a clockwise direction is normally prevented by engagement of the ratchet teeth at its front face with corresponding ratchet teeth formed on the rear face of a restraint wheel 176. The said restraint wheel 176 comprises a reduced diameter hub 177 at its front face which is received in a bore in a front face of the housing 162. Further, at its radially outer face the restraint wheel 176 is provided with two engagement projections 178, which normally engage with a sprung restraint 180 to prevent rotation of the restraint wheel.

The sprung restraint 180 comprises two approximately crescent shaped members 181 (best seen in FIG. 5) joined at respective first tips by a resilient bridge portion 182. In addition, respective second tips of the crescent shaped members are normally joined by the water degradable element 110, which according to the present embodiment is simply a small piece of water softenable paper. Adjacent their respective first tips, both crescent shaped members are penetrated by respective bores 184 which are located on pegs 186 projecting rearward from the front face of the housing 162, the sprung restraint being thereby prevented from rotating. Rearward motion of the sprung restraint 180 is prevented by a partition washer 188.

In the normal configuration of the device (prior to any submersion) the resilient bridge portion 182 exerts a force directed to urge the second tips of the crescent shaped members 181 apart, but this force is resisted by the water degradable element 110. Consequently, cutaways 190 at respective inner faces of the crescent shaped members 181 are normally maintained in engagement with the engagement projections 178 of the restraint wheel 176, preventing rotation both of this wheel and (via the ratchet wheel 170) of the shaft 104.

When water enters the cavity 164, however, it contacts and degrades or dissolves the water degradable element 110, allowing the crescent shaped members 181 to spring apart. The shaft is thus rendered free to rotate under the influence of the coiled spring 106, causing release of gas as previously described.

Entry of water to the cavity 164 occurs via a tube 192 which is integrally formed with the housing 162 and which lies adjacent the water degradable element 110, so that any water entering will immediately contact said element.

However, as has been noted above, the tube 192 is normally closed by the valve 112. This valve comprises a substantially frusto-conical valve member 194 urged, outwardly of the cavity 164, toward an annular valve seat 196, by a helical spring 198.

The valve 112 excludes spray and humidity from the chamber 164, preventing the type of unwanted activation by such factors explained with reference to the prior art.

To open the valve 112, the biasing exerted on the valve member 194 by the helical spring 198 must be overcome by a differential between the exterior pressure and the interior pressure within the chamber 164 (which, because the chamber communicates with the interior of the buoyancy body, is equal to the pressure within the buoyancy body itself). Just such a pressure differential is created when the inflation device is submerged: external water pressure then exceeds internal pressure and so opens the valve 112, admitting water to the chamber and commencing the gas release process. Once the gas cylinder 100 is punctured, internal pressure increases very rapidly, closing the valve 112 and preventing further ingress of water.

Figure 9:
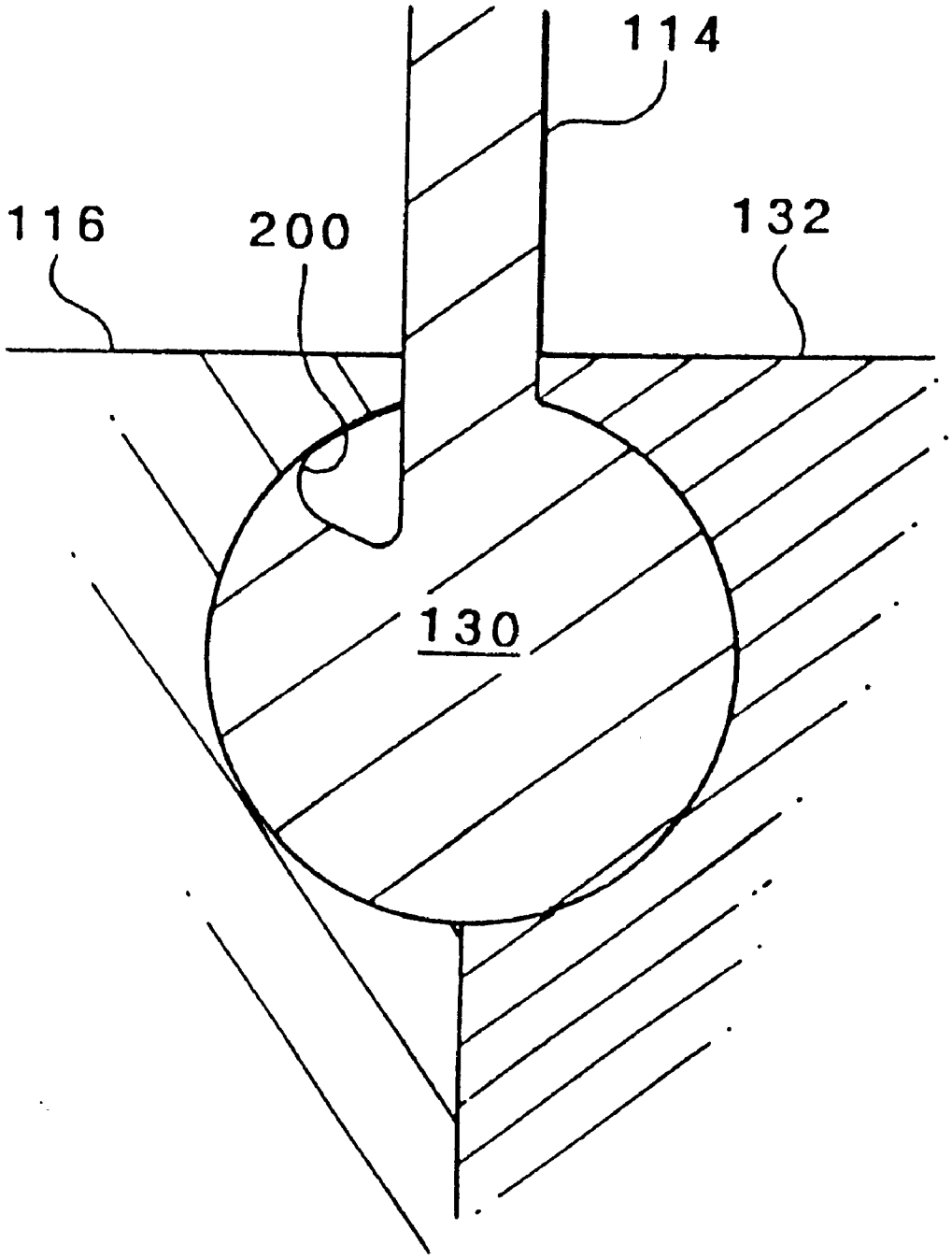
FIG. 9 is an enlarged cross-section of a resilient sealing ring and associated components in accordance with the present invention.

FIG. 9 illustrates, to an enlarged scale, a particularly advantageous form of the sealing ring 132 used in mounting the device on the buoyancy body. The outer surface of the sealing ring is not a complete circle in cross section; it is instead cut away at the region where it meets the skin of the buoyancy body to form an undercut lip 200, which presses outward resiliently against the annular recess in the body 116, forming an improved seal. The seal is improved still further when gas pressure within the buoyancy body increases upon inflation, since this pressure acts on the exposed surface of the undercut lip 200, forcing said lip still more firmly against the body 116.

Figure 8:
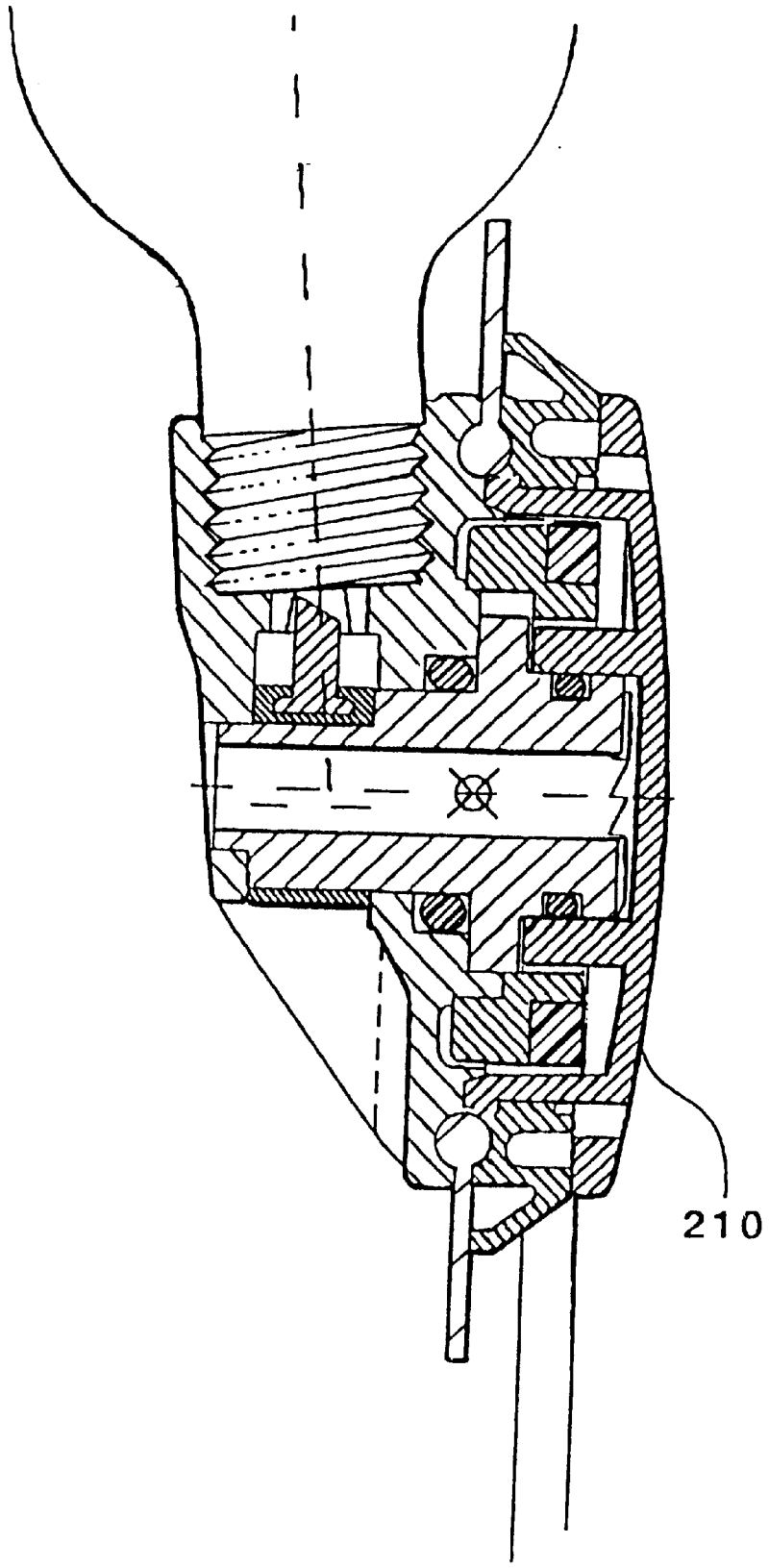
FIG. 8 is a cross-sectional view or a variant of the FIG. 5 embodiment adapted only for manual actuation.

A particular advantage of the present embodiment is that, by virtue of a form of modular design, the bulk of the components (excluding those concerned with automatic activation) can be used in a simple, manual-release-only, device. FIG. 8 illustrates this form of the device. Quite simply, the mounting ring 152 has been replaced with a cover 210. All of the components which, in the automatic version, lie forward of the mounting ring 152 (i.e., the components concerned with automatic activation—the valve, spring, restraint mechanism, housing etc.) are omitted. The remaining components function, as previously described, to permit manual activation.

We claim:

1. An inflation device for a buoyancy body having an outer skin defining an internal cavity and an aperture in the skin, the inflation device comprising cover means adapted to be mounted on the buoyancy body, forming a seal therewith which surrounds the aperture in the skin, means for mounting a gas container and actuating means for causing release of gas from the container, the inflation device being adapted to be automatically actuated upon immersion and additionally comprising means defining a chamber, means defining a first opening or passage for connecting the chamber to the interior of the buoyancy body whereby pressure in the chamber is equalized with pressure at the interior of the buoyancy body, means defining a second opening or passage for connecting the chamber to the exterior, a one way valve which normally closes the second opening or passage, biasing means which constantly urge the actuating means toward a gas release position, and restraint means, comprising a water degradable element disposed within the chamber, which normally retain the actuating means in an inactive position, the one way valve being adapted to be opened by excess external pressure, relative to the pressure within the chamber, produced upon immersion, allowing admission of water to the chamber and consequent release of gas from the gas container into the buoyancy body.

2. An inflation device according to claim 1, wherein the cover means is adapted to be removably mounted on the buoyancy body.

3. An inflation device according to claim 2, wherein the cover means defines a recess adapted to receive a sealing ring of the buoyancy body and thereby to form the seal.

4. An inflation device according to claim 3, wherein the cover means comprises two mutually attachable parts between which the recess is formed.

5. An inflation device according to claim 4, wherein one of the two parts of the cover means is provided with undercut lugs for attachment to the other of the two parts.

6. An inflation device according to any of claims 3 to 5, wherein the sealing ring comprises a resilient undercut lip for resiliently sealing against the recess.

7. An inflation device according to claim 1, wherein the actuating means comprise a rotatably journalled shaft which extends through the cover means.

8. An inflation device according to claim 7, wherein the shaft comprises or is connected to an eccentric associated with a gas release member which is adapted to pierce the gas container, so that rotation of the shaft causes linear displacement of the gas release member and consequent release of gas.

9. An inflation device according to claim 8, further comprising a cord connected via a lever to the shaft, so that tension in the cord causes rotation of the shaft.

10. An inflation device according to claim 1, in which the first opening or passage is formed by a bore in the shaft.

11. An inflation device according to claim 1, wherein the biasing means comprise a spiral spring.

12. An inflatable buoyancy body comprising an outer skin defining an internal cavity, the buoyancy body being provided with an inflator comprising means for mounting a pressurized gas container and actuating means for causing release of gas from the container, the inflator being adapted to automatically cause inflation of the buoyancy body upon immersion and further comprising a housing defining a chamber, means defining a first opening or passage connecting the chamber to the internal cavity of the buoyancy body, whereby pressure in the chamber is equalized with pressure in the internal cavity of the buoyancy body, means defining a second opening or passage for connecting the chamber to the exterior, a one way valve which normally closes the second opening or passage, biasing means which constantly urge the actuating means toward a gas release position, and restraint means, comprising a water degradable element disposed within the chamber, which normally retain the actuating means in an inactive position, the valve being adapted to be opened by excess external pressure, relative to the pressure within the chamber, produced upon immersion allowing admission of water to the chamber and consequent release of gas from the pressurized gas container into the buoyancy body.

13. An inflation device as claimed in claim 1, wherein the means for mounting the gas container are such as to mount the gas container within the buoyancy body and the actuating means extend through the cover means.

* * * * *